US011562870B2

(12) United States Patent
Hayashida et al.

(10) Patent No.: US 11,562,870 B2
(45) Date of Patent: Jan. 24, 2023

(54) ELECTROMAGNETIC RELAY

(71) Applicant: OMRON Corporation, Kyoto (JP)

(72) Inventors: Yasuo Hayashida, Kumamoto (JP); Ryota Minowa, Yamaga (JP); Shingo Mori, Yamaga (JP); Naoki Kawaguchi, Yame (JP); Kohei Otsuka, Omuta (JP); Hiroyuki Iwasaka, Kumamoto (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 17/268,598

(22) PCT Filed: Mar. 5, 2019

(86) PCT No.: PCT/JP2019/008504

§ 371 (c)(1),
(2) Date: Feb. 16, 2021

(87) PCT Pub. No.: WO2020/049764

PCT Pub. Date: Mar. 12, 2020

(65) Prior Publication Data

US 2021/0202198 A1 Jul. 1, 2021

(30) Foreign Application Priority Data

Sep. 7, 2018 (JP) ..... JP2018-167629

(51) Int. Cl.
*H01H 50/54* (2006.01)
*H01H 50/64* (2006.01)
(Continued)

(52) U.S. Cl.
CPC ..... *H01H 50/64* (2013.01); *H01H 1/20* (2013.01); *H01H 50/20* (2013.01); *H01H 50/56* (2013.01); *H01H 2201/022* (2013.01)

(58) Field of Classification Search
CPC ..... H01H 50/64; H01H 1/20; H01H 50/20; H01H 50/56; H01H 2201/022; H01H 50/026; H01H 50/546; H01H 50/641
(Continued)

(56) References Cited

U.S. PATENT DOCUMENTS 3,602,850 A * 8/1971 Grunert ..... H01H 50/546 335/133
3,655,934 A * 4/1972 Turnbull ..... H01H 1/2008 200/275

(Continued)

FOREIGN PATENT DOCUMENTS

CN 204497154 U 7/2015
JP 54-102653 U 7/1979

(Continued)

OTHER PUBLICATIONS

International Search Report of International Application No. PCT/JP2019/008504 dated May 28, 2019.

(Continued)

*Primary Examiner* — Shawki S Ismail
*Assistant Examiner* — Lisa N Homza
(74) *Attorney, Agent, or Firm* — Shinjyu Global IP

(57) ABSTRACT

An electromagnetic relay includes a fixed contact, a movable contact piece, a drive shaft, and a movable iron core. The movable contact piece is movable in a first direction and in a second direction. The drive shaft that extends in the first direction and the second direction and that is coupled to the movable contact piece. The movable iron core is coupled to the drive shaft so as to be integrally movable at a position beyond the movable contact piece in the first direction or at a position beyond the movable contact piece in the second direction. The drive shaft includes a first contact portion configured to contact the movable contact piece, a second (Continued)

contact portion configured to contact the movable iron core, and an insulating portion made from an insulating material and configured to insulate the movable contact piece and the movable iron core from each other.

5 Claims, 8 Drawing Sheets

(51) Int. Cl.
*H01H 1/20* (2006.01)
*H01H 50/20* (2006.01)
*H01H 50/56* (2006.01)

(58) Field of Classification Search
USPC ..... 335/2
See application file for complete search history.

(56) References Cited

U.S. PATENT DOCUMENTS 3,740,510 A * 6/1973 Grunert ..... H01H 50/546 218/1
4,489,296 A * 12/1984 Guery ..... H01H 1/20 200/243
5,546,061 A 8/1996 Okabayashi et al.
6,911,884 B2 * 6/2005 Uotome ..... H01H 50/36 335/132
8,228,144 B2 * 7/2012 Sugisawa ..... H01H 50/00 335/78
2007/0284234 A1 12/2007 Kurasawa et al.
2013/0021121 A1 * 1/2013 Uchida ..... H01H 1/54 335/131
2013/0021122 A1 * 1/2013 Uchida ..... H01H 51/065 335/131
2013/0057377 A1 * 3/2013 Yano ..... H01H 51/06 336/192
2015/0194284 A1 7/2015 Uruma et al.
2017/0069452 A1 3/2017 Hiroki et al.
2017/0358413 A1 12/2017 Tashima et al.
2018/0269017 A1 9/2018 Konishi et al.
2019/0088432 A1 3/2019 Tashima et al.
2019/0304726 A1 10/2019 Ishikawa et al.

FOREIGN PATENT DOCUMENTS

JP 7-235248 A 9/1995
JP 2007-335117 A 12/2007
JP 2014-17086 A 1/2014
JP 2014-232669 A 12/2014
JP 2017-50274 A 3/2017
JP 2017-224440 A 12/2017
JP 2018-106880 A 7/2018

OTHER PUBLICATIONS

Written Opinion of International Searching Authority of International Application No. PCT/JP2019/008504 dated May 28, 2019.
The Office Action of the corresponding Japanese application No. 2018-167629 dated Mar. 8, 2022.

* cited by examiner

ELECTROMAGNETIC RELAY

CROSS-REFERENCE TO RELATED APPLICATION

This application is the U.S. National Phase of International Application No. PCT/JP2019/008504, filed on Mar. 5, 2019. This application claims priority to Japanese Patent Application No. 2018-167629, filed Sep. 7, 2018. The contents of those applications are incorporated by reference herein in their entireties.

FIELD

The present invention relates to an electromagnetic relay.

BACKGROUND

Conventionally, electromagnetic relays that open and close an electric circuit are known. For example, an electromagnetic relay described in Japanese Laid-Open Patent Publication No. 2014-017086 includes a contact device including a fixed contact and a movable contact piece, an electromagnetic drive device, and a drive shaft. The electromagnetic drive device includes a coil, a fixed iron core, and a movable iron core. The drive shaft is made from a conductive material such as metal and is coupled to the movable contact piece and the movable iron core so as to be integrally movable.

When a voltage is applied to the coil of the electromagnetic drive device, the movable iron core is attracted to the fixed iron core and moves upward together with the drive shaft. With the movement of the movable iron core and the drive shaft, the movable contact piece moves toward the fixed contact and contacts the fixed contact.

SUMMARY

In a case where the drive shaft has conductivity, it is necessary to ensure insulation between the movable contact piece and the movable iron core that are coupled to the drive shaft. In order to ensure the insulation between the movable contact piece and the movable iron core, it is necessary to provide a component for ensuring the insulation or to ensure an insulation distance between the movable contact piece and the movable iron core by a part combined with another component. In this case, the number of components may increase and the degree of freedom of design may be limited.

An object of the present invention is to ensure insulation between a movable contact piece and a movable iron core while suppressing an increase in the number of components.

(1) An electromagnetic relay according to one aspect of the present invention includes a fixed contact, a movable contact piece, a drive shaft, and a movable iron core. The movable contact piece includes a movable contact disposed facing the fixed contact and is movable in a first direction in which the movable contact piece contacts the fixed contact and a second direction in which the movable contact piece separates from the fixed contact. The drive shaft extends in the first direction and the second direction and is coupled to the movable contact piece. The movable iron core is coupled to the drive shaft so as to be integrally movable on the first direction side or the second direction side with respect to the movable contact piece. The drive shaft includes a first contact portion contacting the movable contact piece, a second contact portion contacting the movable iron core, and an insulating portion made from an insulating material and insulating the movable contact piece and the movable iron core from each other.

In this electromagnetic relay, the insulation between the movable contact piece and the movable iron core can be ensured by the insulating portion of the drive shaft that is made from the insulating material. As a result, it is not necessary to provide a component for ensuring the insulation between the movable contact piece and the movable iron core or to ensure an insulation distance between the movable contact piece and the movable iron core by a part combined with another component. This enables to reduce the number of components and the assembly steps while increasing the degree of freedom of design.

(2) Preferably, at least one of the first contact portion or the second contact portion is covered with the insulating portion. In this case, it is also possible to reduce the number of components and the assembly steps while increasing the degree of freedom of design.

(3) Preferably, the drive shaft further includes a metal portion that extends in the first direction and the second direction and that is entirely covered with the insulating portion. In this case, rigidity of the drive shaft can be increased.

(4) Preferably, the drive shaft further includes a flange portion made from metal and the electromagnetic relay further includes a contact spring contacting the flange portion of the drive shaft. In this case, for example, as compared with a case where the flange portion is made from an insulating material such as a resin, it is possible to prevent resin waste from being generated due to contact between the flange portion and the contact spring.

(5) Preferably, the first contact portion and the second contact portion are made from metal and the insulating portion is disposed between the first contact portion and the second contact portion. In this case, it is also possible to reduce the number of components and the assembly steps while increasing the degree of freedom of design.

(6) Preferably, the electromagnetic relay further includes a contact case housing the movable contact piece. The contact case includes a through hole through which the drive shaft extends and a portion of the drive shaft that extends through the through hole is covered with the insulating portion.

DETAILED DESCRIPTION

Figure 1:
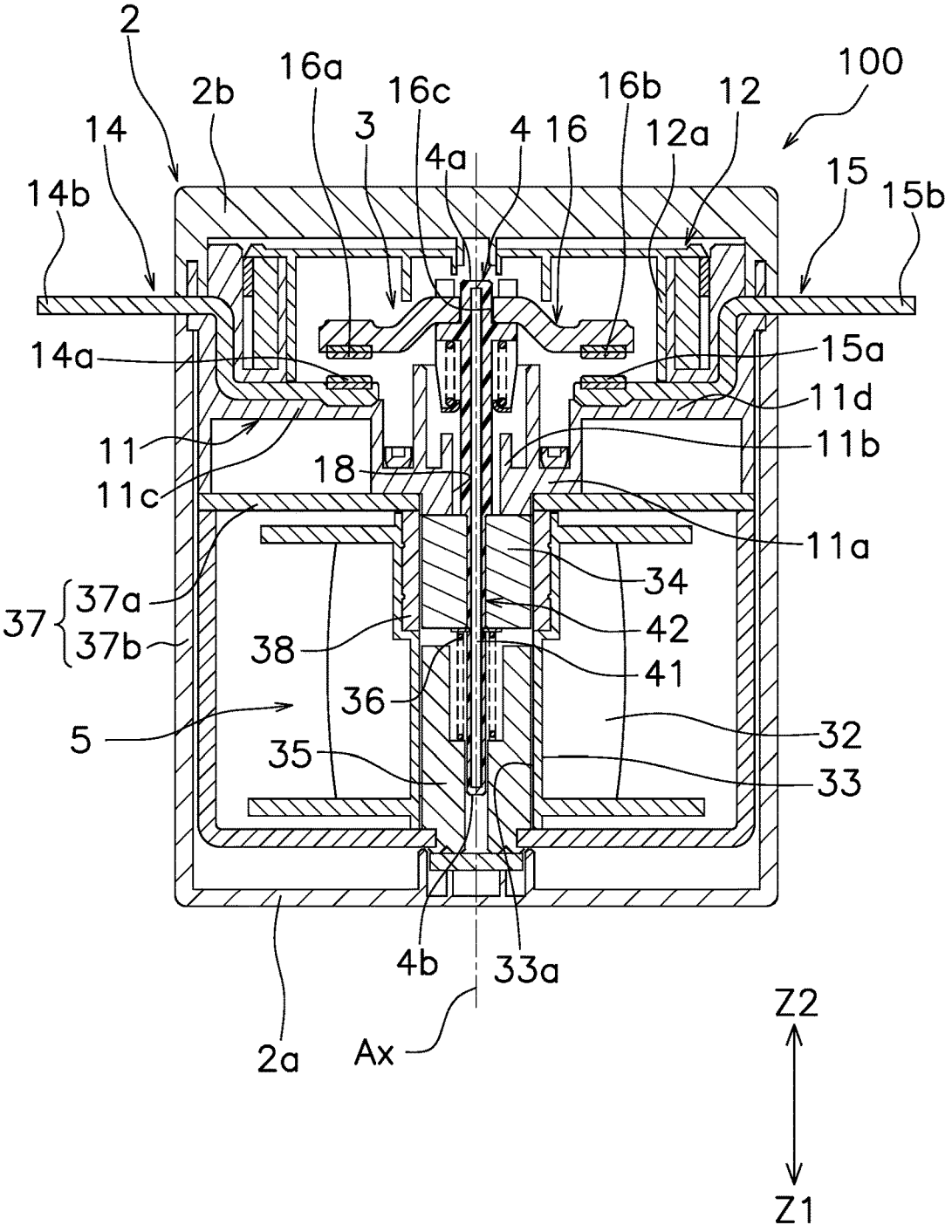
FIG. 1 is a cross-sectional view of an electromagnetic relay according to an embodiment of the present invention.

Hereinafter, embodiments of an electromagnetic relay according to one aspect of the present invention will be described with reference to the drawings. FIG. 1 is a cross-sectional view of an electromagnetic relay 100. As illustrated in FIG. 1, the electromagnetic relay 100 includes a housing 2, a contact device 3, a drive shaft 4, and an electromagnetic drive device 5. In the following description, a direction in which an axis Ax of the drive shaft 4 extends is referred to as an "axial direction". Further, when referring to the drawings, an upper side in FIG. 1 is referred to as "up", a lower side is referred to as "down", a left side is referred to as "left", and a right side is referred to as "right" in order to facilitate understanding of the description.

The housing 2 includes a case 2*a* and a cover 2*b*. The case 2*a* has a substantially rectangular box shape with an upper side open. The cover 2*b* covers the upper side of the case 2*a*. The case 2*a* and the cover 2*b* are made from an insulating material. The contact device 3, the drive shaft 4, and the electromagnetic drive device 5 are housed inside the housing 2.

A contact case 11 that houses the contact device 3 and a contact cover 12 that covers the upper side of the contact case 11 are disposed in the housing 2. The contact case 11 and the contact cover 12 are made from an insulating material.

The contact case 11 includes a bottom portion 11*a*, a cylindrical portion 11*b*, a first contact support portion 11*c*, and a second contact support portion 11*d*. The bottom portion 11*a* is formed in a rectangular plate shape. The longitudinal direction of the bottom portion 11*a* coincides with the left-right direction in FIG. 1.

The cylindrical portion 11*b* cylindrically extends in the axial direction. The cylindrical portion 11*b* protrudes downward from a center of the bottom portion 11*a* and protrudes upward from the center of the bottom portion 11*a*. The cylindrical portion 11*b* has a through hole 18 that penetrates the bottom portion 11*a* in the axial direction. The through hole 18 penetrates the center of the bottom portion 11*a* in the axial direction. The drive shaft 4 penetrates the through hole 18 in the axial direction. The cylindrical portion 11*b* does not necessarily have a cylindrical shape.

The first contact support portion 11*c* is disposed leftward from the center of the bottom portion 11*a* in the longitudinal direction. The first contact support portion 11*c* is formed in a rectangular shape to protrude upward from the bottom portion 11*a*. The second contact support portion 11*d* is disposed rightward from the center of the bottom portion 11*a* in the longitudinal direction. The second contact support portion 11*d* is formed in a rectangular shape to protrude upward from the bottom portion 11*a*.

The contact cover 12 covers the upper side of the contact case 11. The contact cover 12 includes an arc extension wall 12*a* that extends toward the bottom portion 11*a*. The arc extension wall 12*a* is made from, for example, a resin or a ceramic material such as aluminum oxide.

Figure 2:
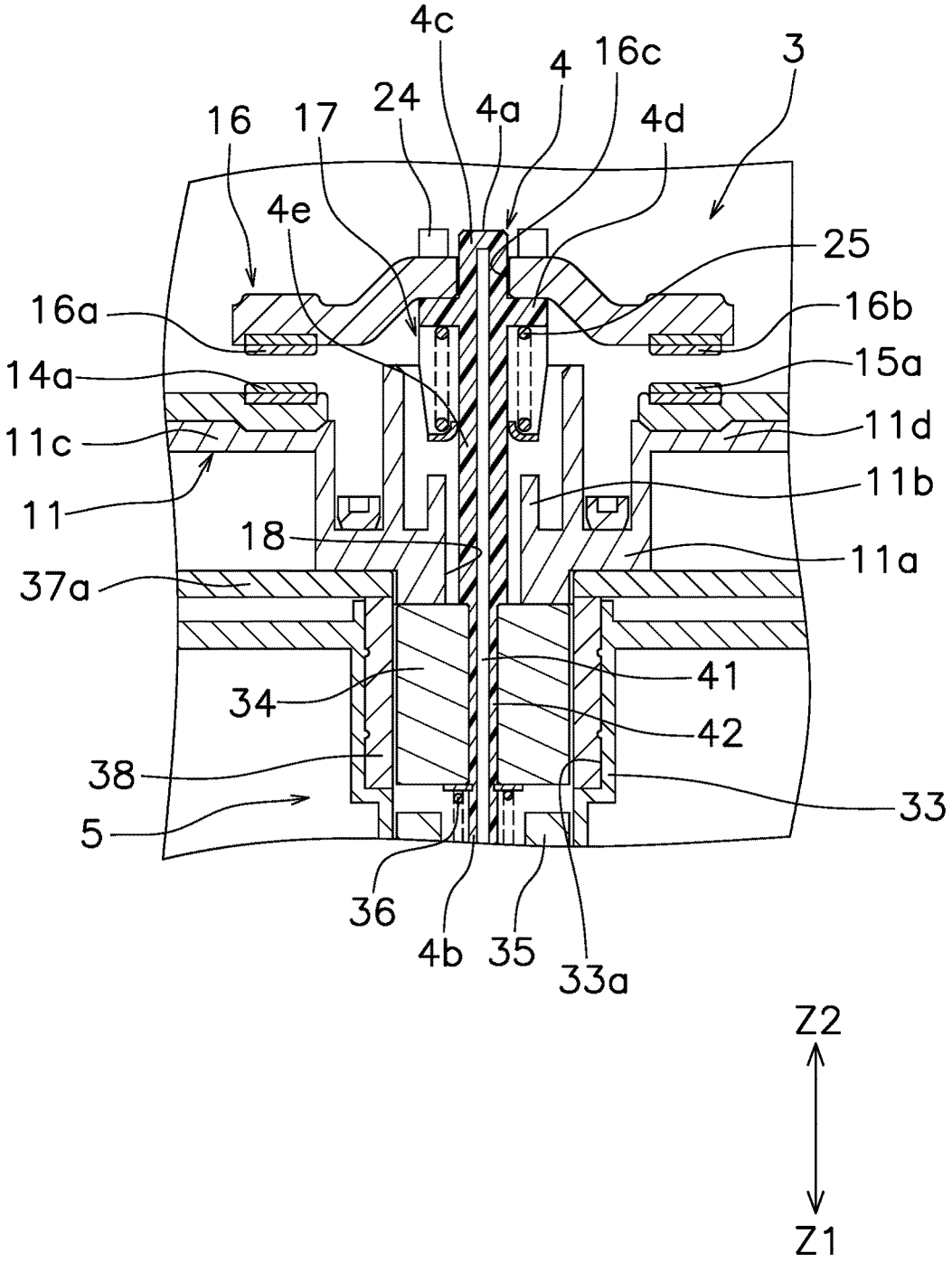
FIG. 2 is an enlarged cross-sectional view of a contact device and its surroundings.

FIG. 2 is an enlarged cross-sectional view of the contact device 3 and its surroundings. As illustrated in FIGS. 1 and 2, the contact device 3 includes a first fixed terminal 14, a second fixed terminal 15, a movable contact piece 16, and a contact piece holding unit 17. The first fixed terminal 14, the second fixed terminal 15, and the movable contact piece 16 are made from a conductive material.

The first fixed terminal 14 extends in the left-right direction and is supported by the first contact support portion 11*c* of the contact case 11 in the housing 2. The first fixed terminal 14 includes a first fixed contact 14*a* and a first external connection portion 14*b*. The first fixed contact 14*a* is disposed above the first contact support portion 11*c* in the contact case 11. The first fixed contact 14*a* is an example of a fixed contact. The first external connection portion 14*b* protrudes from the case 2*a* in the left-right direction.

The second fixed terminal 15 extends in the left-right direction and is supported by the second contact support portion 11*d* of the contact case 11 in the housing 2. The second fixed terminal 15 includes a second fixed contact 15*a* and a second external connection portion 15*b*. The second fixed contact 15*a* is disposed apart from the first fixed contact 14*a* in the left-right direction. The second fixed contact 15*a* is an example of a fixed contact.

The movable contact piece 16 extends in the left-right direction in the contact case 11. The movable contact piece 16 is disposed facing the first fixed contact 14*a* and the second fixed contact 15*a*. The movable contact piece 16 is disposed above the first fixed contact 14*a* and the second fixed contact 15*a*.

The movable contact piece 16 includes a first movable contact 16*a*, a second movable contact 16*b*, and a through hole 16*c*. The first movable contact 16*a* is disposed facing the first fixed contact 14*a* and configured to contact the first fixed contact 14*a*. The second movable contact 16*b* is disposed facing the second fixed contact 15*a* and configured to contact the second fixed contact 15*a*. The first movable contact 16*a* and the second movable contact 16*b* are examples of movable contacts. The through hole 16*c* is a hole that penetrates in the axial direction and is formed at a position that overlaps with the axis Ax of the drive shaft 4.

The movable contact piece 16 is movable in a contact direction Z1 in which the movable contact piece 16 contacts the first fixed contact 14*a* and the second fixed contact 15*a* and a separation direction Z2 in which the movable contact piece 16 separates from the first fixed contact 14*a* and the second fixed contact 15*a*. The contact direction Z1 is an example of a first direction and the separation direction Z2 is an example of a second direction.

The contact direction Z1 is a direction in which the first movable contact 16*a* and the second movable contact 16*b* contact the first fixed contact 14*a* and the second fixed contact 15*a* (downward in FIG. 1). The separation direction Z2 is a direction in which the first movable contact 16*a* and the second movable contact 16*b* separate from the first fixed contact 14*a* and the second fixed contact 15*a* (upward in FIG. 1). The contact direction Z1 and the separation direction Z2 coincide with the axial direction.

As illustrated in FIG. 2, the contact piece holding unit 17 holds the movable contact piece 16 via the drive shaft 4. The contact piece holding unit 17 couples the movable contact piece 16 to the drive shaft 4. The contact piece holding unit 17 includes a holder 24 and a contact spring 25. The movable contact piece 16 is sandwiched and held by an upper portion of the holder 24 and a flange portion 4*d* (described later) of the drive shaft 4 in the axial direction. The contact spring 25 is disposed between a bottom portion of the holder 24 and the flange portion 4*d* in a compressed state.

The drive shaft 4 extends in the contact direction Z1 and the separation direction Z2. A first end 4*a* side of the drive shaft 4 on the separation direction Z2 side is disposed in the contact case 11 and a second end 4*b* side of the drive shaft 4 on the contact direction Z1 side is disposed in a housing portion 33*a* of a spool 33 described later. The drive shaft 4 is coupled to the movable contact piece 16 via the contact piece holding unit 17 and is movable together with the movable contact piece 16 in the contact direction Z1 and the separation direction Z2.

The drive shaft 4 includes a metal portion 41 made from metal and an insulating portion 42 made from an insulating material. The drive shaft 4 is formed by integrally molding the insulating portion 42 with the metal portion 41 by insert molding. In the present embodiment, the metal portion 41 is entirely covered with the insulating portion 42. The metal portion 41 extends in the contact direction Z1 and the separation direction Z2. The metal portion 41 has a rod shape and extends from the first end 4*a* to the second end 4*b*.

The insulating portion 42 is made from an insulating material and insulates the movable contact piece 16 and the movable iron core 34 from each other. The insulating material is, for example, a thermoplastic resin such as a liquid crystal polymer (LCP) or a polybutylene terephthalate (PBT) resin, or a thermosetting resin.

The drive shaft 4 includes a head portion 4*c*, a flange portion 4*d*, and a shaft portion 4*e*. The head portion 4*c* is disposed at the first end 4*a* and penetrates the through hole 16*c* of the movable contact piece 16 in the separation direction Z2. The head portion 4*c* is configured to contact the through hole 16*c* of the movable contact piece 16. The head portion 4*c* is composed of the metal portion 41 and the insulating portion 42. The head portion 4*c* is an example of a first contact portion.

The flange portion 4*d* is disposed at the head portion 4*c* on the contact direction Z1 side. The outer diameter of the flange portion 4*d* is larger than the diameter of the through hole 16*c* of the movable contact piece 16. The surface of the flange portion 4*d* on the separation direction Z2 side is in contact with the movable contact piece 16. The surface of the flange portion 4*d* on the contact direction Z1 side is in contact with the contact spring 25. The flange portion 4*d* is composed of the insulating portion 42. The flange portion 4*d* is an example of the first contact portion.

The shaft portion 4*e* extends from the flange portion 4*d* toward the contact direction Z1. The shaft portion 4*e* passes through the through hole 18 of the contact case 11 and extends into the housing portion 33*a* of the spool 33. Therefore, a portion of the shaft portion 4*e* that passes through the through hole 18 is covered with the insulating portion 42. The shaft portion 4*e* includes the metal portion 41 and the insulating portion 42. The shaft portion 4*e* is an example of a second contact portion.

The electromagnetic drive device 5 moves the drive shaft 4 in the contact direction Z1 and the separation direction Z2. In the housing 2, the electromagnetic drive device 5 is disposed in a space different from where the contact device 3 is disposed. In this embodiment, the electromagnetic drive device 5 is disposed below the contact case 11.

The electromagnetic drive device 5 includes a coil 32, a spool 33, a movable iron core 34, a fixed iron core 35, an urging member 36, and a yoke 37.

The coil 32 is wound around the outer circumference of the spool 33. The spool 33 includes a housing portion 33*a*. The housing portion 33*a* is provided on the inner circumference of the spool 33. The housing portion 33*a* has a cylindrical shape and extends in the axial direction.

The movable iron core 34 is disposed in the housing portion 33*a*. The movable iron core 34 has a cylindrical shape and its center is penetrated by the drive shaft 4 in the axial direction. The movable iron core 34 is movable in the axial direction together with the drive shaft 4. In the present embodiment, the movable iron core 34 is coupled to the drive shaft 4 so as to be integrally movable on the contact direction Z1 side with respect to the movable contact piece 16. Specifically, as illustrated in FIG. 2, the movable iron core 34 is coupled to the shaft portion 4*e* of the drive shaft 4. The insulating portion 42 is interposed between the movable iron core 34 and the metal portion 41 of the drive shaft 4.

The fixed iron core 35 is disposed facing the movable iron core 34 on the contact direction Z1 side with respect to the movable iron core 34 in the housing portion 33*a*. The fixed iron core 35 is fixed to the yoke 37.

The urging member 36 is, for example, a coil spring, and is disposed between the movable iron core 34 and the fixed iron core 35. The urging member 36 urges the movable iron core 34 toward the separation direction Z2. Therefore, the urging member 36 is disposed between the movable iron core 34 and the fixed iron core 35 in a compressed state.

The yoke 37 includes a first yoke 37*a* and a second yoke 37*b*. The first yoke 37*a* has a plate shape and is disposed between the bottom portion 11*a* of the contact case 11 and the spool 33. The first yoke 37*a* overlaps with a lower portion of the cylindrical portion 11*b* in the left-right direction. The first yoke 37*a* is connected to a ring iron core 38. The second yoke 37*b* has a substantially U shape and a bottom portion of the second yoke 37*b* is disposed below the spool 33. The upper ends of both sides of the second yoke 37*b* are connected to the first yoke 37*a*.

Next, the operation of the electromagnetic relay 100 will be described. FIG. 1 illustrates a state in which no voltage is applied to the coil 32. When no voltage is applied to the coil 32, the urging member 36 prevents the movable iron core 34 from moving in the contact direction Z1. Therefore, the first movable contact 16*a* and the second movable contact 16*b* are in a state of being separated from the first fixed contact 14*a* and the second fixed contact 15*a*.

Figure 3:
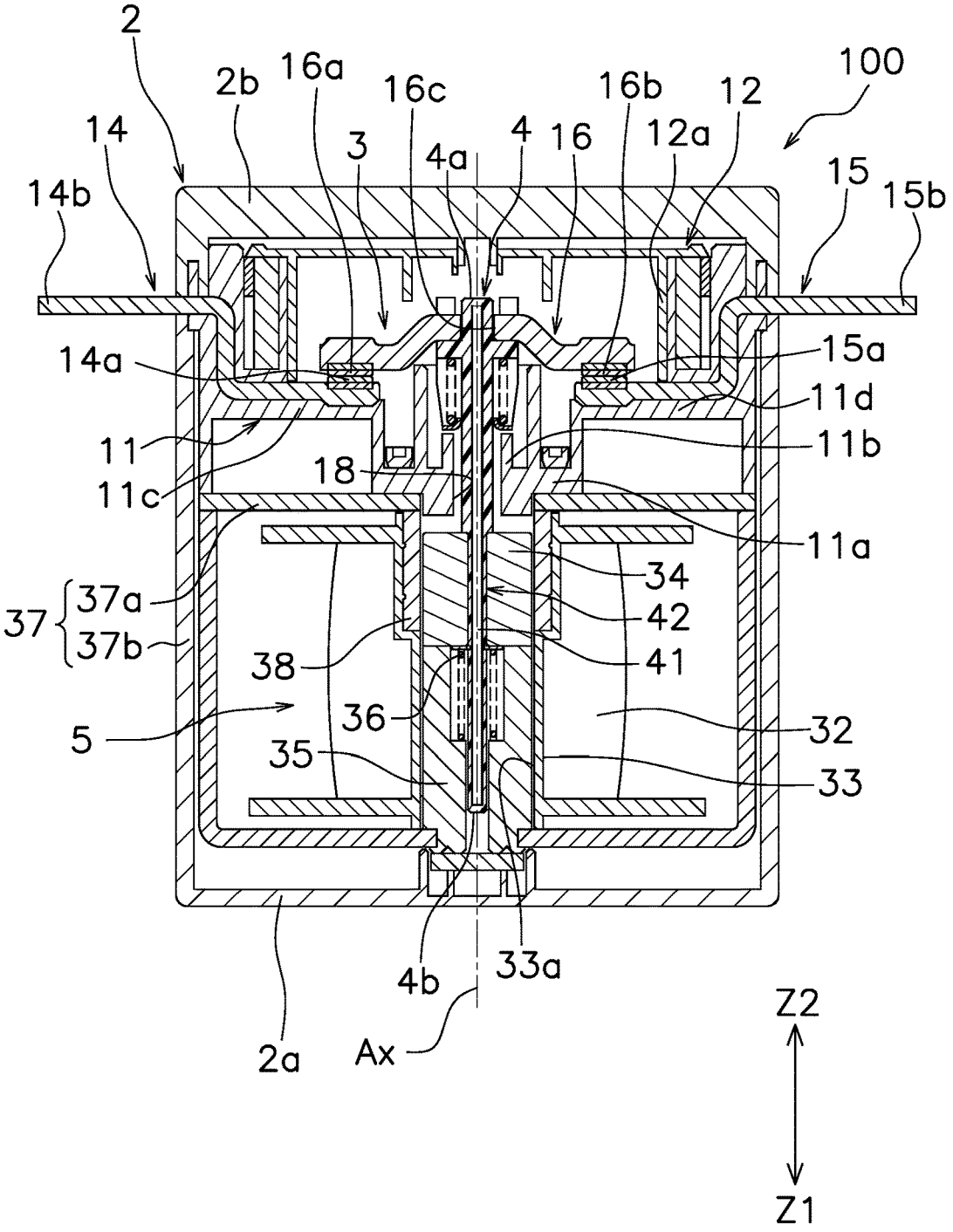
FIG. 3 is a cross-sectional view of the electromagnetic relay when a voltage is applied to a coil.

FIG. 3 illustrates a state in which a voltage is applied to the coil 32. When a voltage is applied to the coil 32 and the coil 32 is magnetized, the movable iron core 34 moves in the contact direction Z1 against an elastic force of the urging member 36 due to an electromagnetic force of the coil 32. With the movement of the movable iron core 34, the drive shaft 4 and the movable contact piece 16 move in the contact direction Z1, and the first movable contact 16*a* and the second movable contact 16*b* contact the first fixed contact 14*a* and the second fixed contact 15*a*.

When the application of the voltage to the coil 32 is stopped, the movable iron core 34 moves in the separation direction Z2 due to the elastic force of the urging member 36, and the first movable contact 16*a* and the second movable contact 16*b* separate from the first fixed contact 14*a* and the second fixed contact 15*a*.

When the first movable contact 16*a* and the second movable contact 16*b* contact the first fixed contact 14*a* and the second fixed contact 15*a*, it is necessary to ensure insulation between the movable contact piece 16 and the movable iron core 34. In the present embodiment, the insulation between the movable contact piece 16 and the movable iron core 34 is ensured by the insulating portion 42 of the drive shaft 4. As a result, it is not necessary to provide a new component for ensuring the insulation or to ensure an insulation distance between the movable contact piece and the movable iron core by a part combined with another component. This enables to reduce the number of components and the assembly steps of the electromagnetic relay 100 while increasing the degree of freedom of design.

Although an embodiment of the electromagnetic relay according to one aspect of the present invention has been described so far, the present invention is not limited to the above embodiment and various modifications can be made without departing from the gist of the invention. For example, the configuration of the electromagnetic drive device 5 may be changed. The shape or disposition of the movable contact piece 16, the coil 32, the spool 33, the movable iron core 34, the fixed iron core 35, the urging member 36, or the yoke 37 may be changed. The shape or disposition of the housing 2, the contact case 11, or the contact cover 12 may be changed. For example, the present invention may be applied to a configuration in which the movable iron core 34 is disposed on the separation direction Z2 side with respect to the movable contact piece 16.

Figure 4:
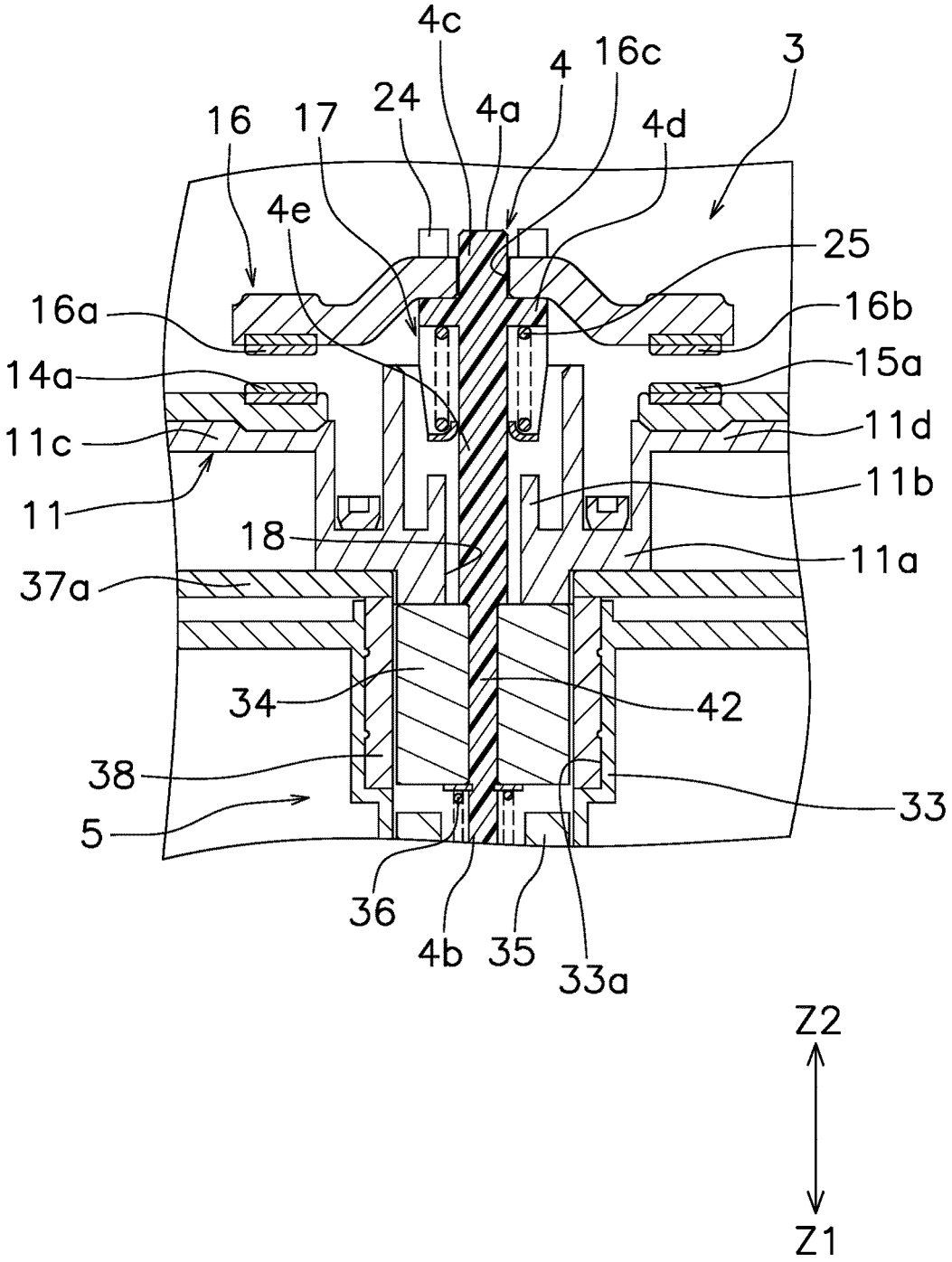
FIG. 4 is an enlarged cross-sectional view of the contact device and its surroundings according to another embodiment.

In the above embodiment, the metal portion 41 is disposed on the drive shaft 4 to increase the rigidity of the drive shaft 4, but the metal portion 41 is not necessarily disposed. For example, as illustrated in FIG. 4, the entire drive shaft 4 may be formed of the insulating portion 42. That is, the drive shaft 4 may be formed of only an insulating material.

Figure 5:
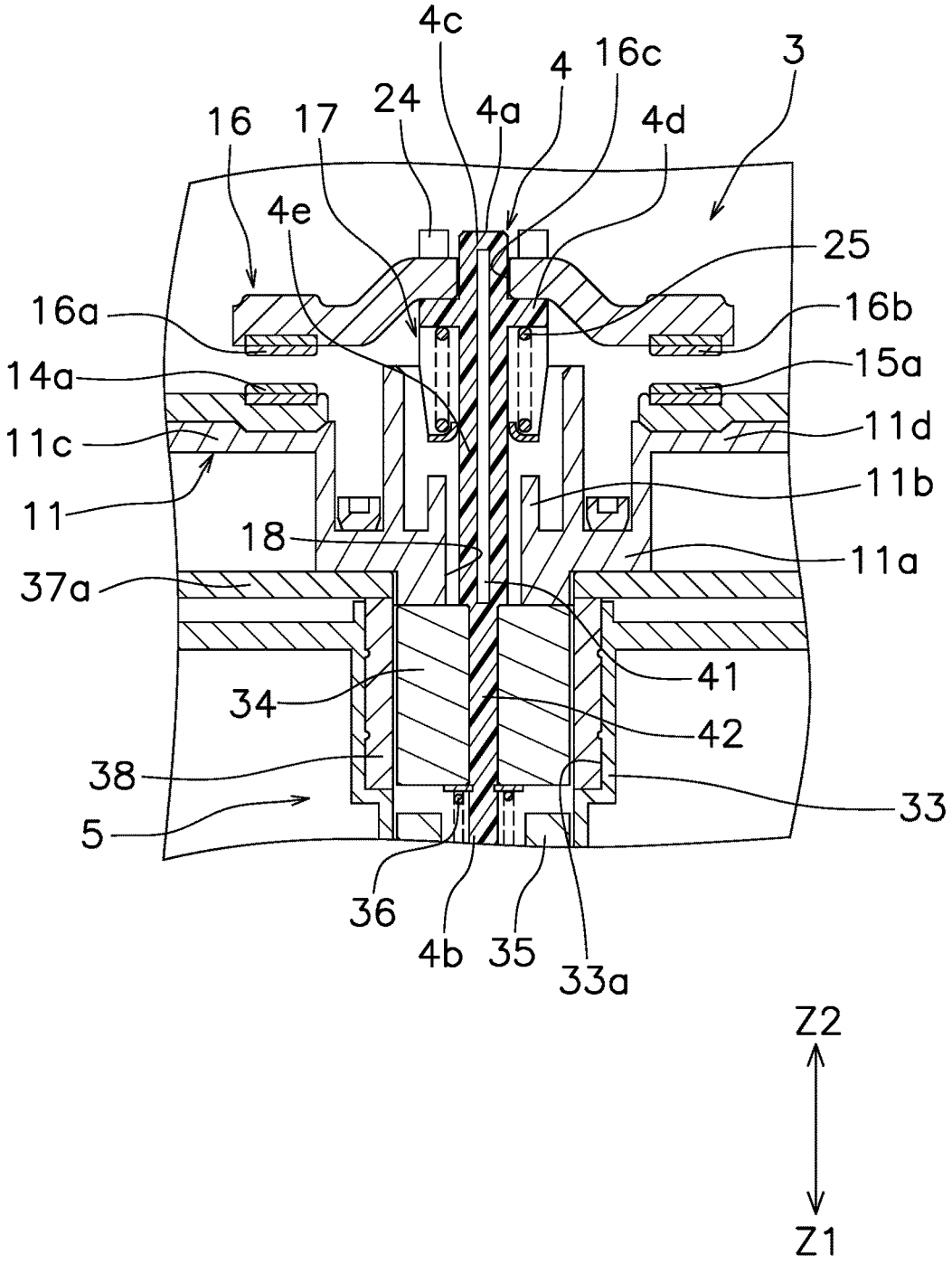
FIG. 5 is an enlarged cross-sectional view of the contact device and its surroundings according to another embodiment.
Figure 6:
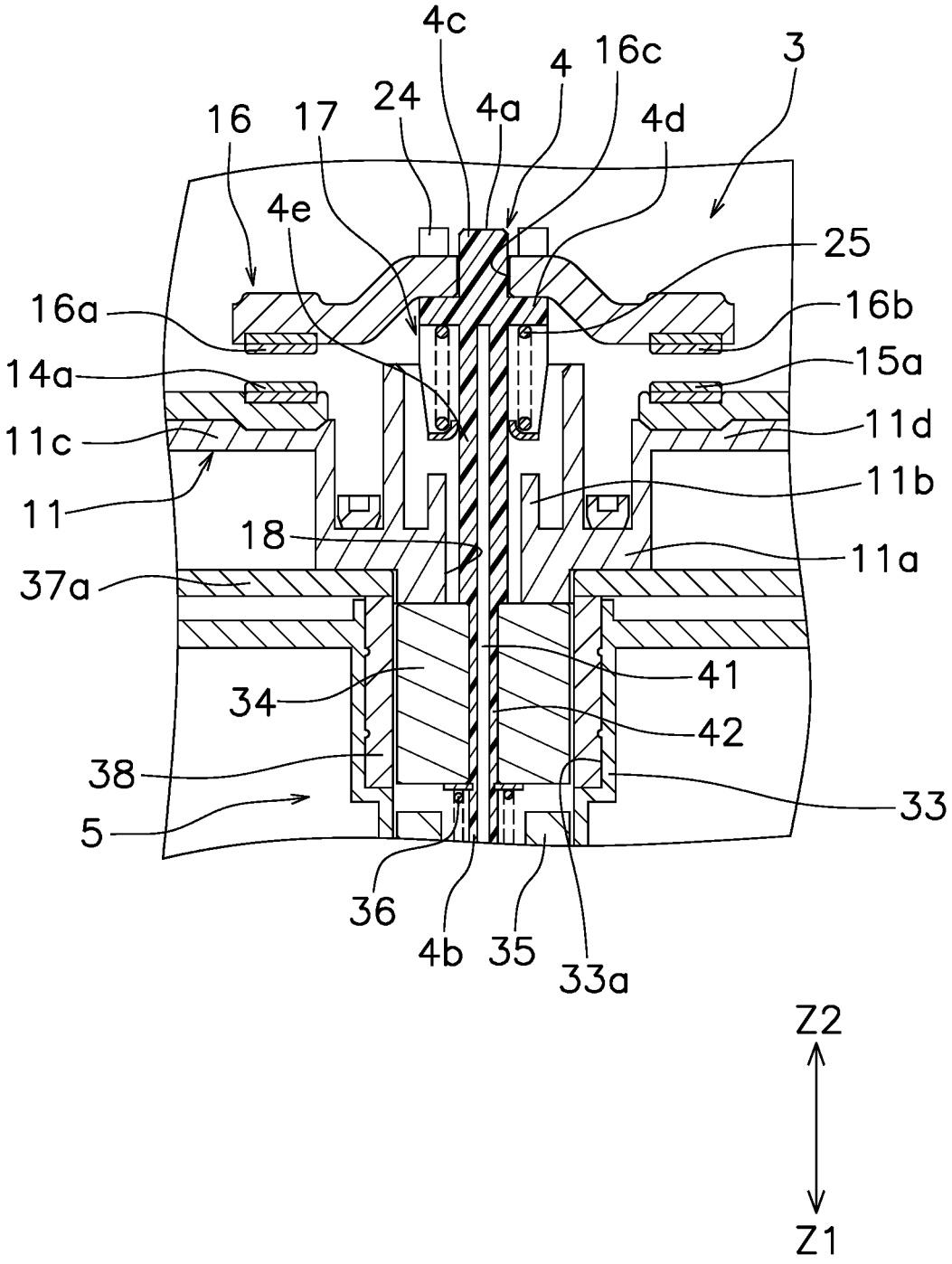
FIG. 6 is an enlarged cross-sectional view of the contact device and its surroundings according to another embodiment.
Figure 7:
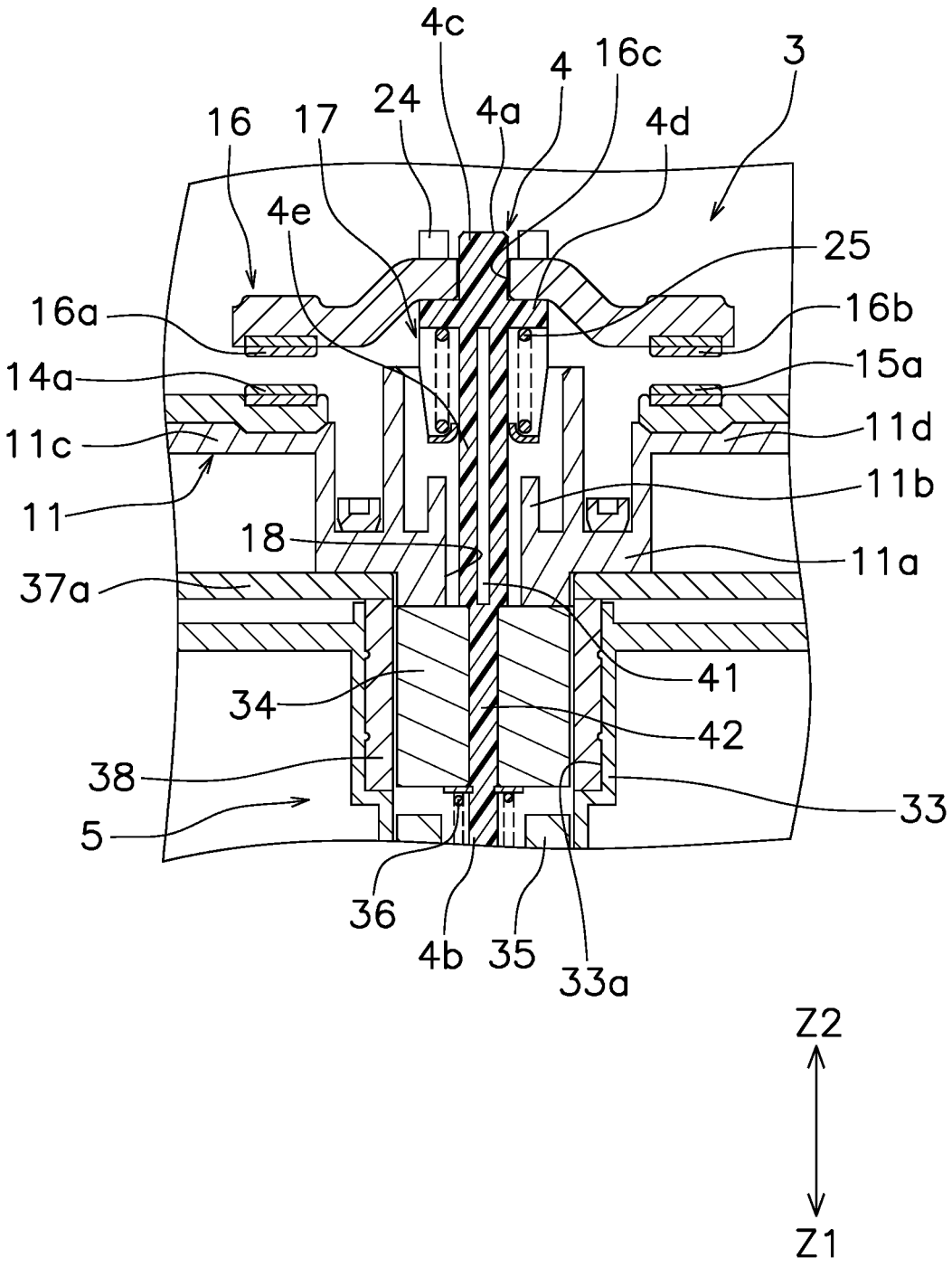
FIG. 7 is an enlarged cross-sectional view of the contact device and its surroundings according to another embodiment.

The shape of the metal portion 41 is not limited to that of the above embodiment. For example, as illustrated in FIGS. 5 to 7, the length in the axial direction or disposition of the metal portion 41 may be changed. Specifically, as illustrated in FIG. 5, the metal portion 41 may be disposed from the head portion 4*c* to a position proximate to the movable iron core 34. As illustrated in FIG. 6, the metal portion 41 may be disposed only on a portion of the shaft portion 4*e* of the drive shaft 4. As illustrated in FIG. 7, the metal portion 41 may be disposed from the first end 4*a* side of the shaft portion 4*e* of the drive shaft 4 to a position proximate to the movable iron core 34.

In the above embodiment, the insulating portion 42 covers the entire metal portion 41, but does not necessarily cover the entire metal portion 41. The insulating portion 42 only needs to be configured to insulate the movable contact piece 16 and the movable iron core 34 from each other.

Figure 8:
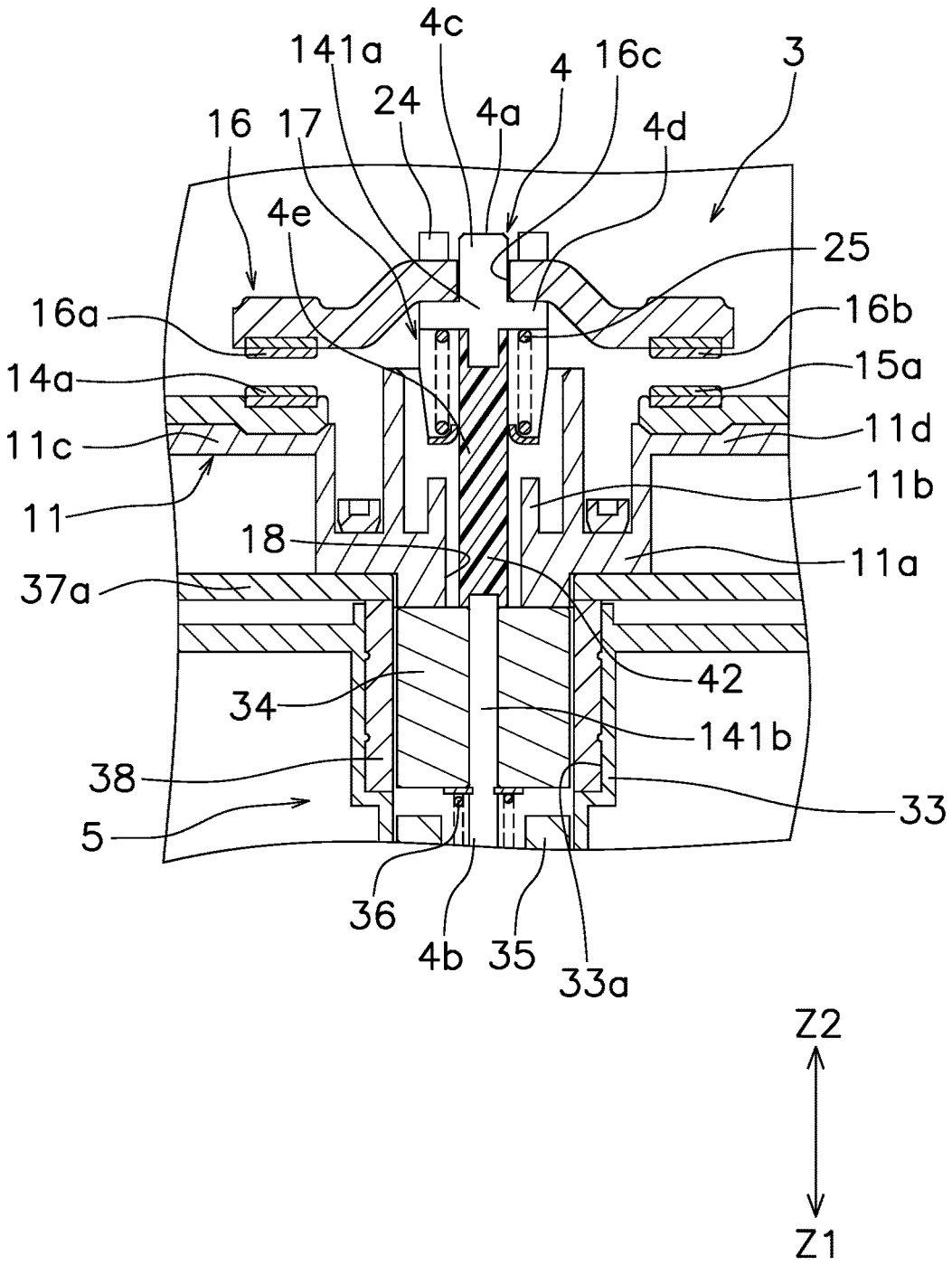
FIG. 8 is an enlarged cross-sectional view of the contact device and its surroundings according to another embodiment.

For example, as illustrated in FIG. 8, metal portions 141*a* and 141*b* may be disposed on both ends of the drive shaft 4, and the insulating portion 42 may be disposed between the metal portion 141*a* and the metal portion 141*b*. The metal portions 141*a*, 141*b* and the insulating portion 42 are integrally formed by insert molding or press fitting. Specifically, the head portion 4*c* and the flange portion 4*d* of the drive shaft 4 are composed of the metal portion 141*a*. The shaft portion 4*e* of the drive shaft 4 is composed of the insulating portion 42 and the metal portion 141*b*. The insulating portion 42 extends from the flange portion 4*d* to a position proximate to the movable iron core 34. The metal portion 141*b* extends from an end of the insulating portion 42 on the contact direction Z1 side to the second end 4*b*, and the movable iron core 34 is coupled to the metal portion 141*b*. In this case, the movable iron core 34 can be firmly fixed to the drive shaft 4. Further, as compared with a case where the flange portion 4*d* of the drive shaft 4 is composed of the insulating portion 42, it is possible to prevent resin waste from being generated due to contact between the contact spring 25 and the flange portion 4*d*. The shaft portion 4*e* of the drive shaft 4 may be composed of only the insulating portion 42.

REFERENCE NUMERALS

4 Drive shaft
4*c* Head portion (an example of the first contact portion)
4*d* Flange portion (an example of the first contact portion)
4*e* Shaft portion (an example of the second contact portion)
11 Contact case
14*a* First fixed contact (an example of the fixed contact)
15*a* Second fixed contact (an example of the fixed contact)
16 Movable contact piece
16*a* First movable contact (an example of the movable contact)
16*b* Second movable contact (an example of the movable contact)
18 Through hole
25 Contact spring
34 Movable iron core
41, 141*a*, 141*b* Metal portion
42 Insulating portion
100 Electromagnetic relay
Z1 Contact direction (an example of the first direction)
Z2 Separation direction (an example of the second direction)

The invention claimed is:

1. An electromagnetic relay comprising:
a fixed contact;
a movable contact piece including a movable contact disposed facing the fixed contact, the movable contact piece being movable in a first direction in which the movable contact piece contacts the fixed contact and in a second direction in which the movable contact piece separates from the fixed contact;
a drive shaft that extends in the first direction and the second direction, the drive shaft being coupled to the movable contact piece; and
a movable iron core coupled to the drive shaft so as to be integrally movable at a position beyond the movable contact piece in the first direction or at a position beyond the movable contact piece in the second direction,
the drive shaft including
a first contact portion configured to contact the movable contact piece,
a second contact portion configured to contact the movable iron core,
an insulating portion made from an insulating material and configured to insulate the movable contact piece and the movable iron core from each other, and
a metal portion that extends in the first direction and the second direction, the metal portion being entirely covered with the insulating portion, the metal portion being fixed to the insulating portion.

2. The electromagnetic relay according to claim 1, wherein
at least one of the first contact portion or the second contact portion is covered with the insulating portion.

3. The electromagnetic relay according to claim 1 further comprising:
a contact spring, wherein
the drive shaft further includes a flange portion made from metal, the flange portion configured to contact the contact spring.

4. The electromagnetic relay according to claim 1, wherein
the first contact portion and the second contact portion are made from metal, and
the insulating portion is disposed between the first contact portion and the second contact portion.

5. The electromagnetic relay according to claim 1, further comprising:
a contact case configured to house the movable contact piece, wherein the contact case has a through hole through which the drive shaft extends, and the drive shaft includes a portion that extends through the through hole, the portion being covered with the insulating portion.

* * * * *